US011445867B2

(12) United States Patent
Colon et al.

(10) Patent No.: US 11,445,867 B2
(45) Date of Patent: Sep. 20, 2022

(54) COMMODE EXTENSION

(71) Applicant: C & R Health Care Innovations LLC, Ocala, FL (US)

(72) Inventors: Pedro Colon, Ocala, FL (US); Aurelio Reyes, Mount Dora, FL (US)

( * ) Notice: Subject to any disclaimer, the term of this patent is extended or adjusted under 35 U.S.C. 154(b) by 0 days.

(21) Appl. No.: 17/345,979

(22) Filed: Jun. 11, 2021

(65) Prior Publication Data

US 2021/0386254 A1 Dec. 16, 2021

Related U.S. Application Data

(60) Provisional application No. 63/037,644, filed on Jun. 11, 2020.

(51) Int. Cl.
*A47K 11/04* (2006.01)
*A47K 17/02* (2006.01)

(52) U.S. Cl.
CPC ..... *A47K 11/04* (2013.01); *A47K 17/02* (2013.01)

(58) Field of Classification Search
CPC ..... A47K 11/04
USPC ..... 4/661
See application file for complete search history.

(56) References Cited

U.S. PATENT DOCUMENTS 4,613,994 A * 9/1986 Oates ..... A47K 11/04 4/480
4,894,871 A * 1/1990 Schmerler ..... A47K 17/026 135/67
5,023,962 A * 6/1991 Steljes ..... A47K 11/04 4/479
5,133,377 A * 7/1992 Truxillo ..... A61H 3/04 135/75
5,787,515 A * 8/1998 Mason ..... A47K 17/026 5/604

* cited by examiner

*Primary Examiner* — Huyen D Le
(74) *Attorney, Agent, or Firm* — Eugenio J. Torres-Oyola; Victor M. Rodriguez-Reyes; Rafel Rodriguez-Muriel

(57) ABSTRACT

A commode extension for facilitating movement of individuals with disabilities having a support frame with pivotally connected sections, wherein said support frame is in turn connected to a commode.

4 Claims, 6 Drawing Sheets

COMMODE EXTENSION

FIELD OF THE DISCLOSURE

This disclosure relates to a rotational commode extension for assisting an individual to sit on or stand from the commode.

BACKGROUND OF THE DISCLOSURE

Many areas of a house, such as bathrooms and other small rooms, do not have space that is adequate for allowing individuals (especially those with physical disabilities) to move or transfer from one point to another without difficulty, discouraging the individual from using assistive equipment or causing the individual to hold onto unsuitable surfaces, which can cause excessive forces or pressure to muscles and/or joints. Failure to use proper equipment or not performing good movement mechanics could cause musculoskeletal discomfort or injury, or joint or nervous system injuries. As a consequence, people should use assistive equipment to avoid the risk of falls.

Falls can occur at any time and to anyone, but over the years the risk is greater. Health complications from falls can range from just simple injuries to life-threatening injuries. In the United States, these accidents constitute the seventh leading cause of death in elderly people, and it is estimated that 50% of deaths are related to falls. Falls are the cause of more than 8 million emergency room (ER) visits each year, and the numbers outnumber any other type of injury or illness that requires a visit to a hospital emergency room. Half of accidental fall deaths occur in the home.

The Centers for Disease Control and Prevention (CDC) reports that 1 in 3 adults over the age of 65 suffer falls, leading from moderate to severe injuries. As a consequence, the most common injuries suffered are hip fractures and head trauma, which increases the risk of death. For older adults, falls are the leading cause of fatal and non-fatal injuries. The CDC reports that during a typical year, 2.4 million fatal falls require emergency room treatment, and of these, more than 722,000 patients were admitted for treatment at the facility. To prevent falls, much remains to be done. Education, counseling and the use of assistance teams are necessary tools to reduce these statistics.

It is well-known that commodes provide assistance to individuals with physical disabilities. Commodes, however, are difficult to introduce into small spaces due to their bulky structure. It is also cumbersome or inconvenient to carry additional assistive equipment (such as walkers, canes or wheelchairs) in combination with a commode. As such, individuals with physical disabilities using a commode usually step away from the commode without the aid of assistive equipment and instead rely on adjacent furniture or structure for support. This puts these individuals at risk of falling or injuring themselves. Accordingly, it would be desirable to have a commode that does not require the need of additional assistive equipment but provides the user the necessary support to move in small spaces such as those typically associated with household bathrooms.

As discussed in more detail below, the invention relates a commode extension comprising a support frame with pivotally connected sections, wherein said support frame is in turn connected to a commode. The person using the extension can be transferred from his or her initial spot (such as a wheelchair) to the commode using the rack, which will serve as a walker, attached to the sitting surface. The rack also protects the individual from falling once seated in the commode.

With the commode extension, individuals do not need any other equipment to assist them in moving away or to the commode. The walker-type grill is tied to one of the sides of the commode. The grill opens at the part next to the person, uses it to take steps towards the commode, sits down and closes the grid. Once seated, the grill protects the user from falling or slipping. When standing up, the user can use the rack as a walker to get to the next stop.

SUMMARY OF THE DISCLOSURE

The disclosure relates to a commode extension, comprising a support frame having a first sub-frame, a second sub-frame and sub-frame bars connecting the first sub-frame to the second sub-frame; a commode having first and second front legs that are opposite to first and second rear legs; wherein the commode includes a first bar having a first end fastened to the first front leg and a second end fastened the second front leg; wherein the commode includes a second bar having a first end fastened to the first rear leg and a second end fastened to the second rear leg; wherein the commode includes a first top bar connecting an upper end of the first front leg with an upper end of the first rear leg; wherein the commode includes a second top bar connecting an upper end of the second front leg with an upper end of the second rear leg; wherein the commode includes a seat fastened on top of the first bar and the second bar; wherein the commode includes a back rail attached to the upper end of the first rear leg and the upper second of the second rear leg; wherein the first sub-frame includes a first leg and a second leg; wherein the second subframe includes a first leg and a second leg; wherein the first sub-frame includes a first top bar connecting an upper end of the first sub-frame first leg with an upper end of the first sub-frame second leg; wherein the second sub-frame includes a second top bar connecting an upper end of the second sub-frame first leg with an upper end of the second sub-frame second leg; wherein the first sub-frame first leg is rigidly fastened or connected to the first front leg of the commode; and wherein the second sub-frame is fastened to one or more sub-frame bars, which in turn are pivotally connected, via one or more pivot joints, to the first sub-frame.

DETAILED DESCRIPTION OF THE DISCLOSURE

Figure 1:
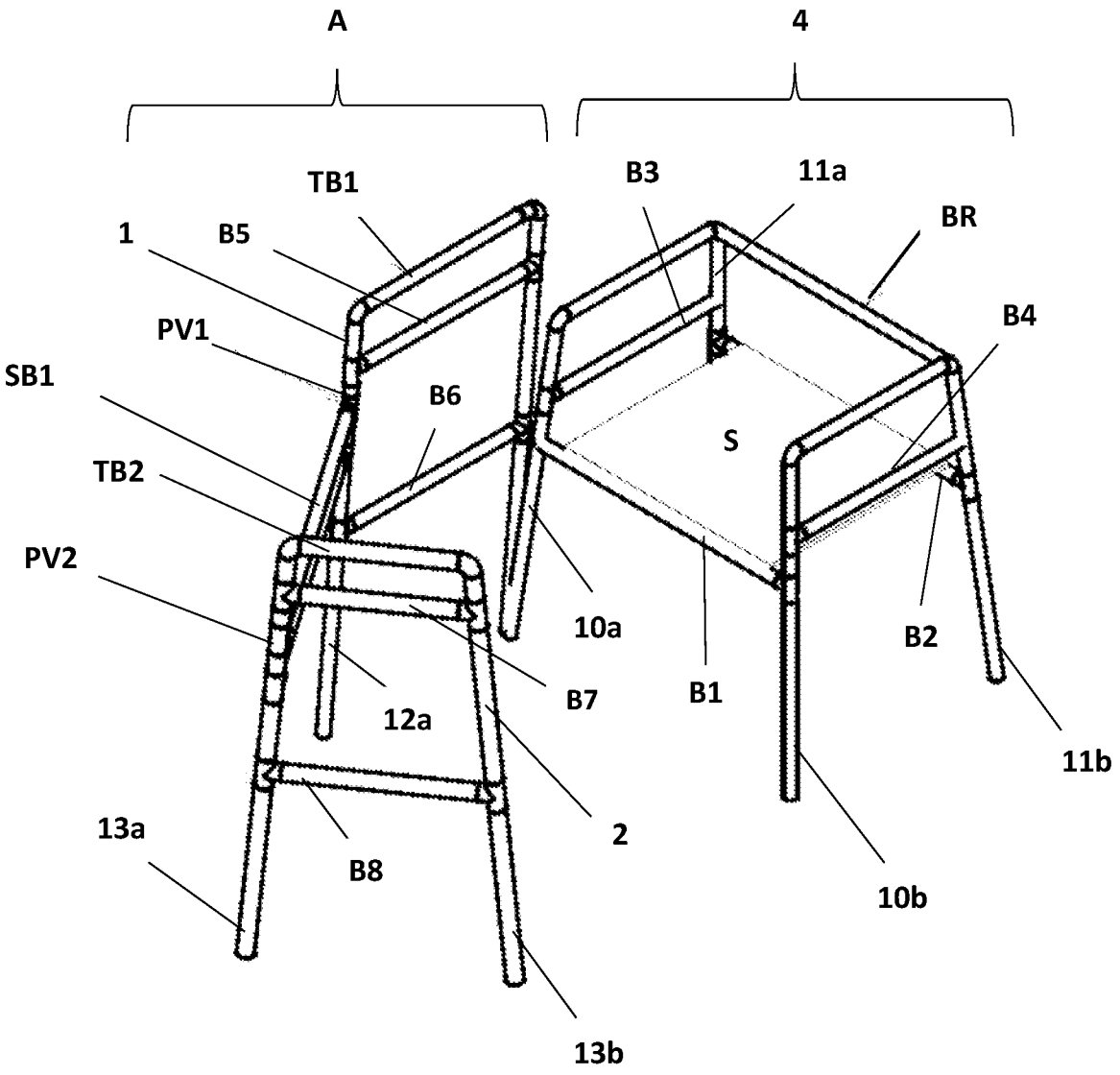
FIG. 1 is a perspective view of a commode extension in its open configuration.
Figure 2:
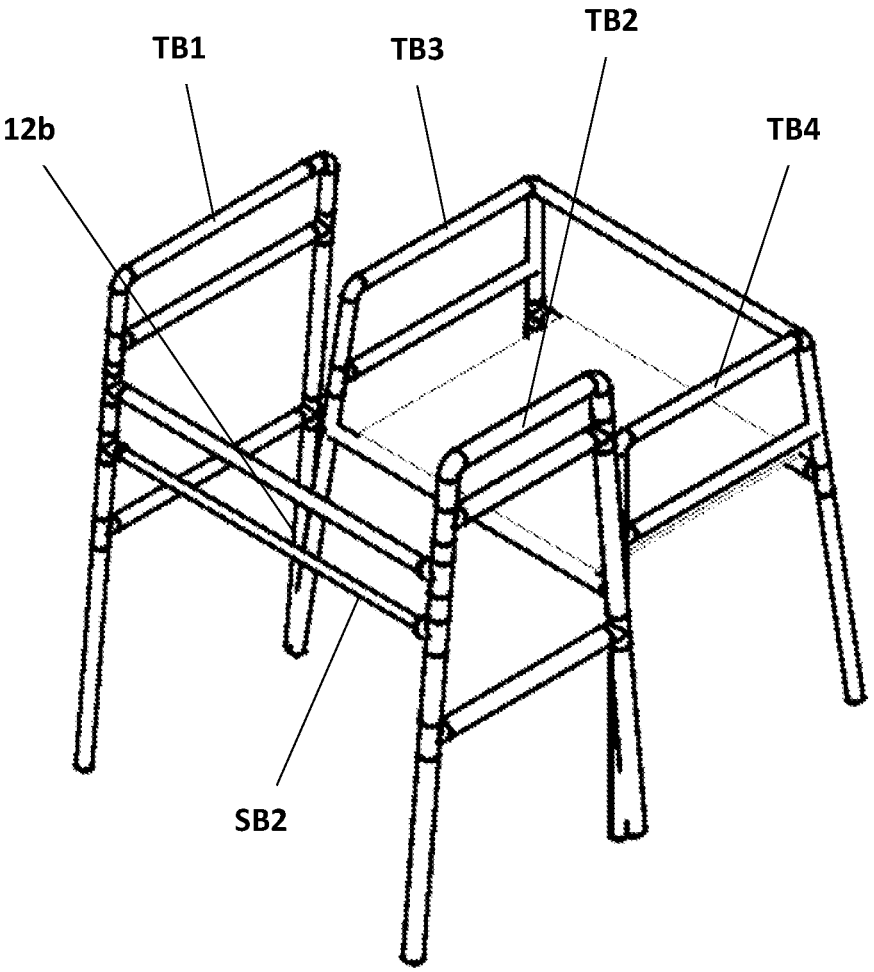
FIG. 2 is a perspective view of the commode extension in its closed configuration.

The disclosure relates a commode extension comprising a support frame A with interconnected sections or sub-frames 1, 2, wherein said support frame A is in turn connected to a commode 4. As shown in FIGS. 1-6, the commode 4 comprises first and second front legs 10*a*, 10*b* and first and second rear legs 11*a*, 11*b*, wherein the front legs 10*a*, 10*b* and rear legs 11*a*, 11*b* are opposite to each other. Moreover, the commode 4 comprises a first bar B1 that connects (or is fastened to) the first front leg 10*a* to the second front leg 10*b* at a mid-point; and a second bar B2 that connects the first rear leg 11*a*with the second rear leg 11*b* at a mid-point, as shown in FIG. 1. Moreover, the commode 4 includes a first top bar TB3 connecting an upper end or portion of the first front leg 10*a* with an upper end or portion of the first rear leg 11*a*. Similarly, the commode 4 includes a second top bar TB4 connecting an upper end of the second front leg 10*b* with an upper end of the second rear leg 11*b*. The top ends provide support to a user of when sitting on the commode.

The commode 4 may optionally include a third bar B3 connecting the first front leg 10*a* to the first rear leg 11*a* and fourth bar B4 connecting the second front leg 10*b* to the second rear leg 11*b*, in order to provide more stability to the commode 4. Lastly, the commode 4 comprises a seat S fastened to and placed on top of the first and second bars B1, B2; and a back rail BR for providing back support to the user of the commode 4. The back rail BR is connected to an upper end or portion of the first rear leg 11*a* and to an upper portion of the second rear leg 11*b*. The bars B1, B2, B3, B4, connecting the front and rear legs may be fastened or welded to the corresponding leg. Similarly, the back rail BR may be fastened or welded to a top end or portion of the first and second rear legs 11*a*, 11*b*. The material of the commode 4 and support frame A can be selected from any strong, durable material such a plastic, metal or any other similar material.

As previously noted, the commode extension comprises a support frame A that includes a first sub-frame 1 and a second sub-frame 2. The first sub-frame comprises a first leg 12*a* and a second leg 12*b*. Similarly, the second sub-frame 2 comprises a first leg 13*a* and a second leg 13*b*. The first sub-frame 1 may optionally include one or more bars B5, B6 connecting each first sub-frame leg 12*a*, 12*b*; and the second sub-frame 2 may optionally include one or more bars B7, B8 connecting each second sub-frame leg 13*a*, 13*b*, in order to provide more stability to the first and second sub-frames 1, 2. Moreover, the first sub-frame 1 includes a first top bar TB1 connecting an upper end or portion of the first sub-frame first leg 12*a* with an upper end or portion of the first sub-frame second leg 12*b*. Similarly, the second sub-frame 2 includes a second top bar TB2 connecting an upper end or portion of the second sub-frame first leg 13*a* with an upper end or portion of the second sub-frame second leg 13*b*. The top bars TB1, TB2 allow a user of the commode to use these bars for support when sitting down or standing up from the seat S. It should be noted that the sub-frame first leg 12*a* and second leg 12*b* of the first sub-frame 1; as well as the first leg 13*a* and second leg 13*b* of the second sub-frame 2, may extend obliquely and away from the center of the corresponding top bar. This configuration provides additional stability to the support frame A, as shown in FIGS. 1, 2, 4 and 6.

The first sub-frame 1 is rigidly fastened or connected, via the sub-frame first leg 12*a*, to the first front leg 10*a*. The sub-frame first leg 12*a* may be fastened or welded to the first front leg 10*a* or integrated into the first front leg 10*a*. The second sub-frame 2, on the other hand, is connected, fastened, or welded to one or more sub-frame bars SB1, SB2, which in turn are pivotally connected, via one or more pivot joints PV1, to the first sub-frame 1. As such, the sub-frame bars SB1, SB2 rotate at the juncture in which they are pivotally connected to the first sub-frame 1. It should be noted that one end of the sub-frame bars SB1, SB2 is pivotally connected to the sub-frame 1 while the other end of the sub-frame bars SB1, SB2 is connected, fastened, or welded to the second sub-frame 2. Alternatively, the second sub-frame 2 may also be pivotally connected, via one or more pivot joints PV2, to the one or more sub-frame bars SB1, SB2, which in turn are pivotally connected to the first sub-frame 1 via the one or more pivot joints PV1. The pivot connection allows the second sub-frame 2 and sub-frame bars SB to rotate away from the commode 4. This allows a user of the commode 4 to alternate between a closed and open configuration depending on his or her preference, as shown in FIGS. 1-6.

Figure 3:
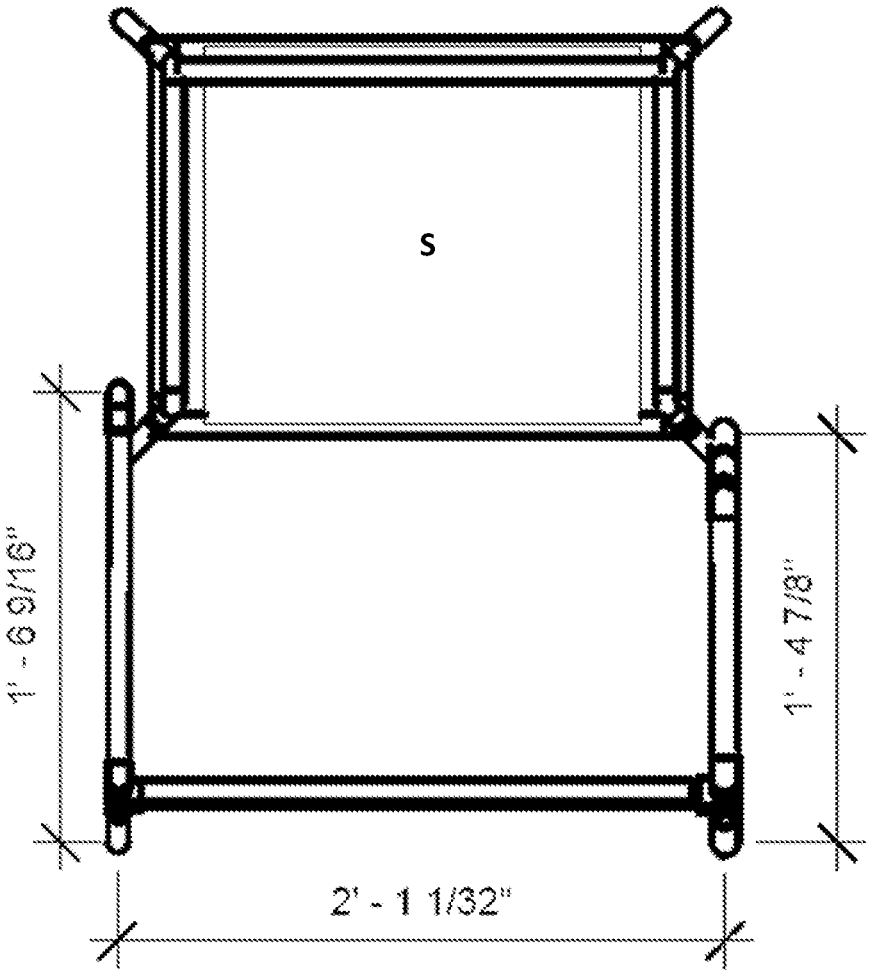
FIG. 3 is a top view of the commode extension with the extension in its closed configuration.
Figure 4:
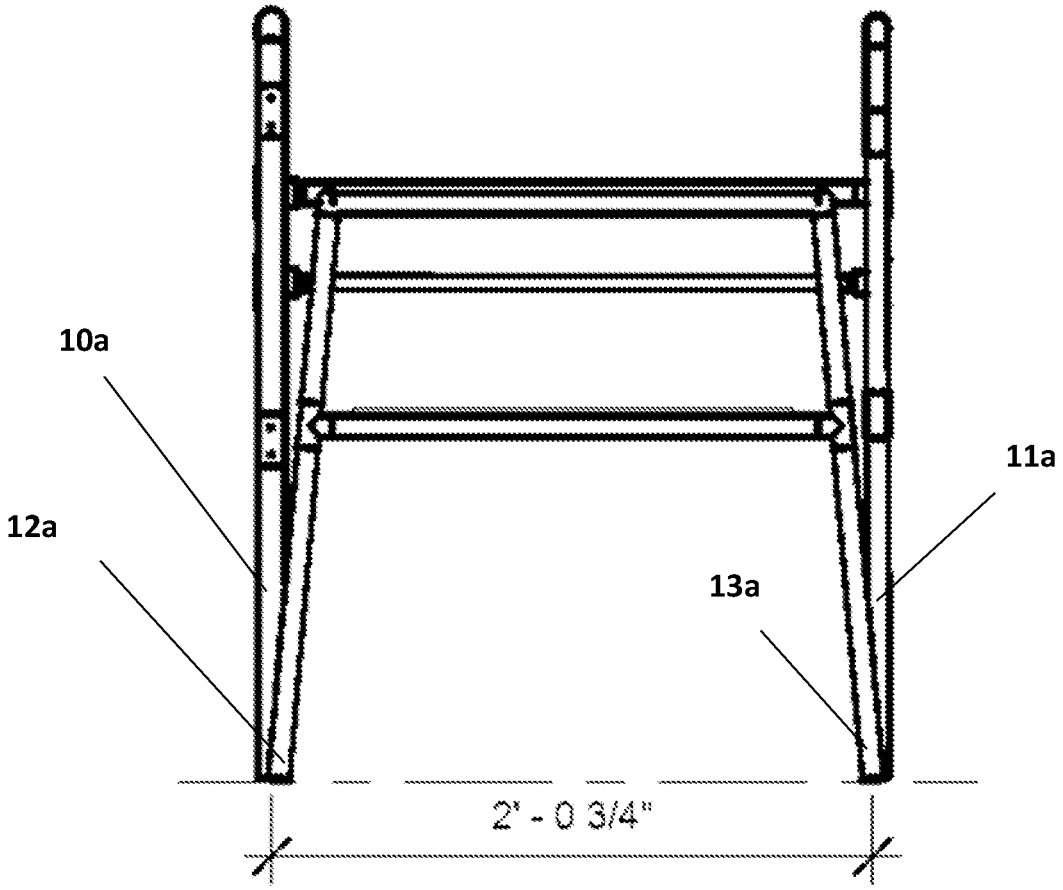
FIG. 4 is a front view of the commode extension.
Figure 5:
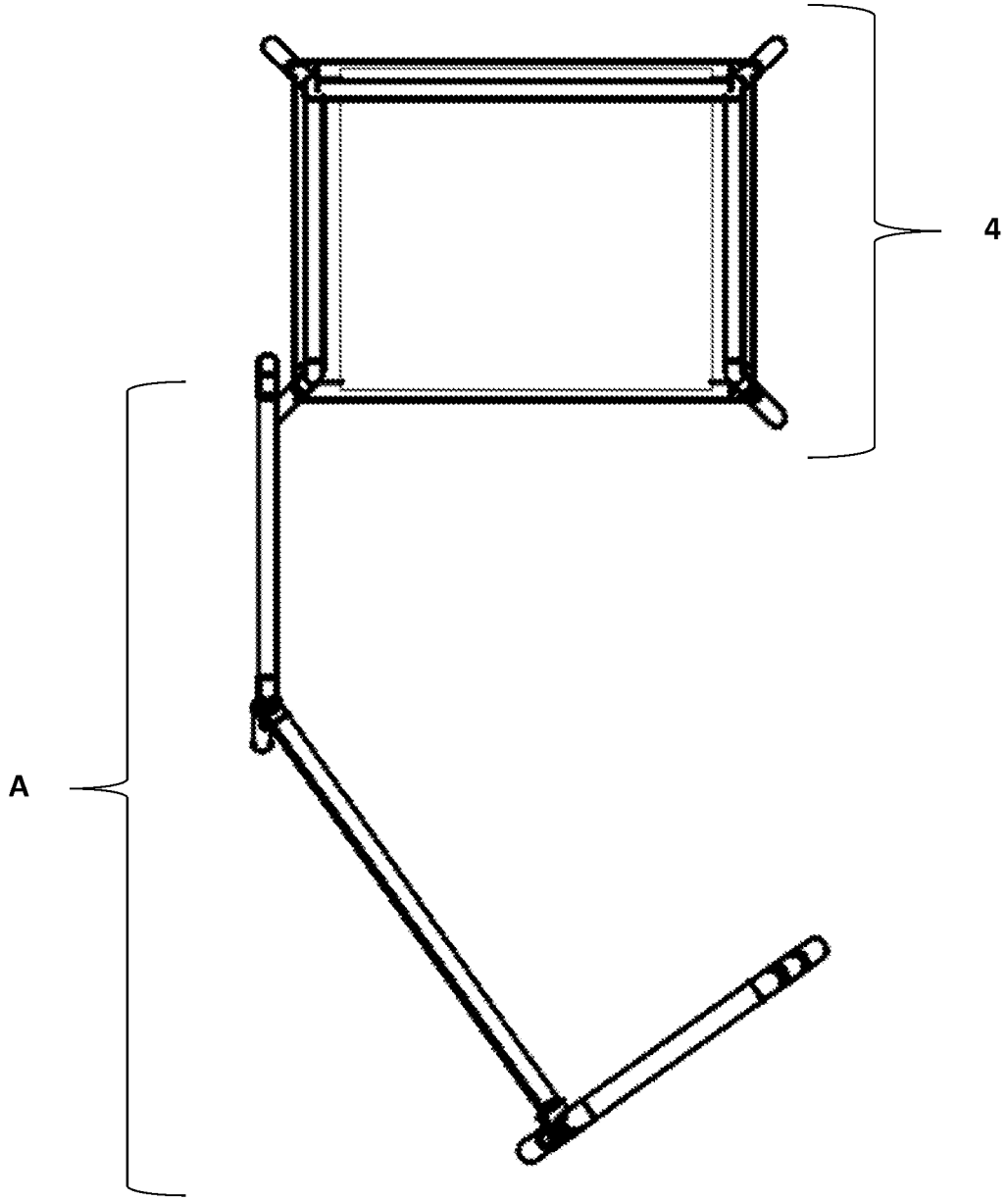
FIG. 5 is a top view of the commode extension with the extension in its open configuration.
Figure 6:
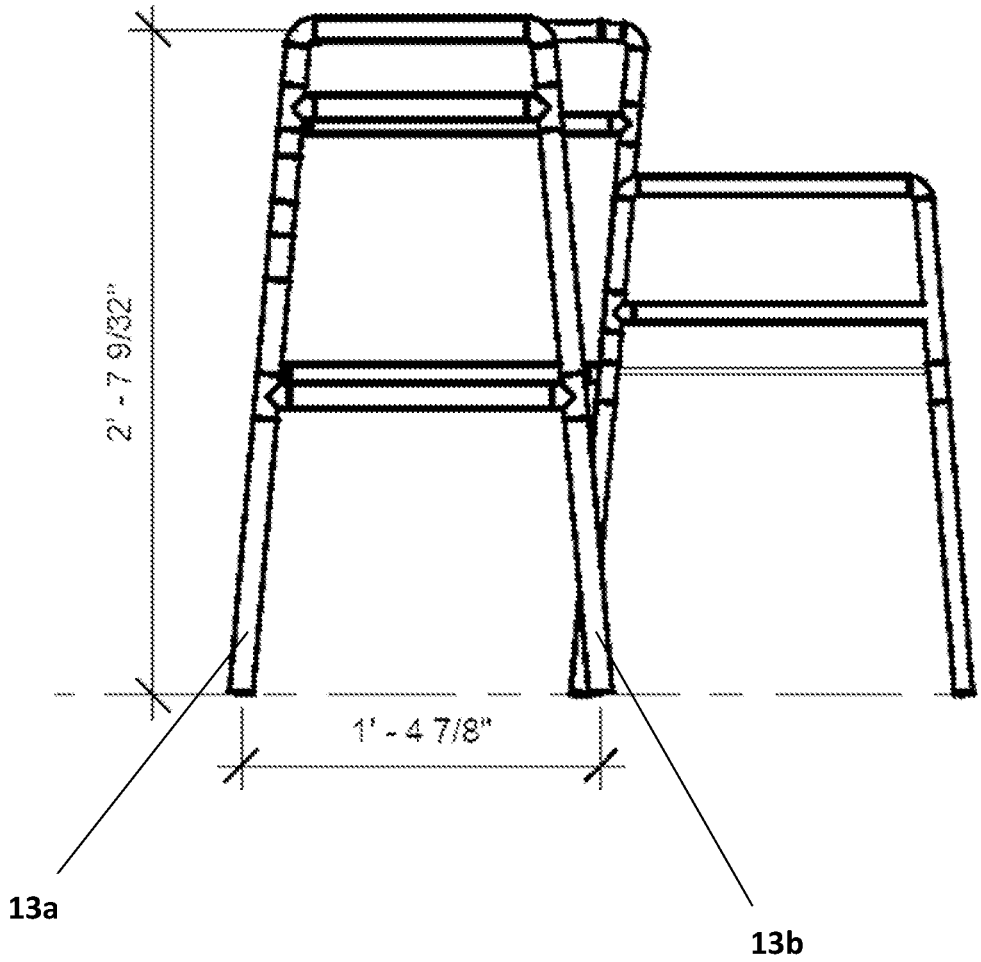
FIG. 6 is a side view of the commode extension.

As shown in FIGS. 3, 4 and 6, certain elements of the support frame A have certain preferred measurements. For example, the length of the first top bar TB1 is preferably 1 feet and 6⁹⁄₁₆ inches; the length of the sub-frame bars SB1, SB2 measure 2 feet and 1¹⁄₃₂ inches; and the length of the second top bat TB2 measures 1 feet and 4⁷⁄₈ inches. The difference in length between the first sub frame 1 and the second subframe 2, facilitates closure of the support from A when implementing the closed configuration of the commode 4. The height of the first and second sub-frames of the support frame A is preferably 5 feet and 7⁹⁄₃₂ inches, as shown in FIG. 6. The distance between the sub-frame first legs 12*a*, 13*a* and the corresponding sub-frame second legs 12*b* and 13*b* is preferably 1 feet and 4⁷⁄₈ inches, as also shown in FIG. 6. Lastly, the distance between the first sub-frame first leg 12*a* and the second sub-frame first leg 13*a* is preferably 2 feet and ¾ inches, as shown in FIG. 4.

Although certain exemplary embodiments and methods have been described in some detail, for clarity of understanding and by way of example, it will be apparent from the foregoing disclosure to those skilled in the art that variations, modifications, changes, and adaptations of such embodiments and methods may be made without departing from the true spirit and scope of the claims. Therefore, the above description should not be taken as limiting the scope of the invention which is defined by the appended claims.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means plus function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patently distinguish any amended claims from any applied prior art.

What is claimed is:

1. A commode extension, comprising:

a support frame having a first sub-frame, a second sub-frame and sub-frame bars connecting the first subframe to the second sub-frame;

a commode having first and second front legs that are opposite to first and second rear legs;

wherein the commode includes a first bar having a first end fastened to the first front leg and a second end fastened the second front leg;

wherein the commode includes a second bar having a first end fastened to the first rear leg and a second end fastened to the second rear leg;

wherein the commode includes a first top bar connecting an upper end of the first front leg with an upper end of the first rear leg;

wherein the commode includes a second top bar connecting an upper end of the second front leg with an upper end of the second rear leg;

wherein the commode includes a seat fastened on top of the first bar and the second bar;

wherein the commode includes a back rail attached to the upper end of the first rear leg and the upper second of the second rear leg;

wherein the first sub-frame includes a first leg and a second leg;

wherein the second subframe includes a first leg and a second leg;

wherein the first sub-frame includes a first top bar connecting an upper end of the first sub-frame first leg with an upper end of the first sub-frame second leg;

wherein the second sub-frame includes a second top bar connecting an upper end of the second sub-frame first leg with an upper end of the second sub-frame second leg;

wherein the first sub-frame first leg is rigidly fastened or connected to the first front leg of the commode; and wherein the second sub-frame is fastened to one or more sub-frame bars, which in turn are pivotally connected, via one or more pivot joints, to the first sub-frame, thereby providing for the rotation of the second sub-frame in a direction away from the commode.

2. The commode extension of claim 1, wherein the commode further comprises a third bar connecting the first front leg to the first rear leg and fourth bar connecting the second front leg to the second rear leg.

3. The commode extension of claim 1, wherein first sub-frame includes one or more bars connecting each first sub-frame leg.

4. The commode extension of claim 1, wherein the second sub-frame includes one or more bars connecting each second sub-frame leg.

* * * * *